US005630296A

United States Patent [19]

Kendall, Jr.

[11] Patent Number: 5,630,296

[45] Date of Patent: May 20, 1997

[54] INFLATABLE EMERGENCY SHELTER

[76] Inventor: Robert T. Kendall, Jr., 1381 Rounds Ave., Grants Pass, Oreg. 97527

[21] Appl. No.: 295,393

[22] Filed: Aug. 25, 1994

[51] Int. Cl.[6] ..... E04H 15/40; E04B 1/34

[52] U.S. Cl. ..... 52/2.11; 52/2.18; 52/3; 52/DIG. 12; 135/97; 135/128; 135/137

[58] Field of Search ..... 52/2.11, 2.18, 52/2.22, 3, DIG. 12; 135/88.01, 88.03, 88.05, 88.13, 97, 20.2, 128, 125, 126, 137, 138, 143

[56] References Cited

U.S. PATENT DOCUMENTS

| | | | |
|---|---|---|---|
| 3,629,875 | 12/1971 | Dow et al. | 52/2.11 X |
| 3,911,913 | 10/1975 | June | 128/142.5 |
| 4,283,888 | 8/1981 | Cros | 52/3 |
| 4,825,892 | 5/1989 | Norman | 135/126 |
| 4,858,395 | 8/1989 | McQuirk | 52/3 |
| 4,991,363 | 2/1991 | Randmae | 52/2.11 |
| 5,038,812 | 8/1991 | Norman | 135/126 |
| 5,137,044 | 8/1992 | Brady | 135/126 |
| 5,163,461 | 11/1992 | Ivanovich et al. | 135/126 |
| 5,226,261 | 7/1993 | Wilbourn et al. | 52/2.22 X |
| 5,242,206 | 9/1993 | Heck | 52/2.22 X |
| 5,305,561 | 4/1994 | Goddard | 52/2.22 |
| 5,343,887 | 9/1994 | Danaher | 135/128 X |
| 5,423,150 | 6/1995 | Hitchcock | 52/3 X |
| 5,430,980 | 7/1995 | Ferrier | 135/126 X |

FOREIGN PATENT DOCUMENTS

| | | | |
|---|---|---|---|
| 1282385 | 12/1961 | France | 52/2.22 |
| 9417266 | 8/1994 | WIPO | 52/2.11 |

*Primary Examiner*—Wynn E. Wood
*Attorney, Agent, or Firm*—Robert M. Sperry

[57] ABSTRACT

Temporary emergency structures comprising inflatable frameworks formed of ultra-high temperature resistant fabric tubing which may insulate the protected person or equipment from the ground and which serves to support a cover formed of ultra-high temperature resistant fabric cloth.

15 Claims, 5 Drawing Sheets

INFLATABLE EMERGENCY SHELTER

BACKGROUND

1. Field of Invention

This invention relates to temporary structures and is particularly directed to improved temporary structures which are inflatable to provide emergency protection for personnel, equipment, buildings, vessels and the like against fires, as well as harsh arctic and desert conditions.

2. Prior Art

Forest and range fires are extremely dangerous and can move from one location to another at speeds which can exceed 50 miles per hour. Furthermore, in fire storms, burning embers are often carried by the wind and, hence, leap through the air for substantial distances. As a result, firefighters are frequently trapped by such fast-moving fires and may suffer serious injury or death. In addition, bulldozers and other firefighting equipment often become trapped by such fires, resulting in the annual loss of hundreds of thousands of dollars of such equipment. To reduce the risks for human firefighters, unsupported tent-like structures have been provided, formed of glass cloth and foil laminate material. Unfortunately, these glass cloth and foil laminates have a melting point of about 1200° F., whereas fire storm temperatures are typically in the range of 1100° F. and may reach as much as 1800° F. Furthermore, at temperatures of only 500° F., the glass cloth and foil delaminates can decompose and release toxic gases. In addition, it may be necessary to clear a ground area of 4×8 feet, prior to erecting the temporary structures of the prior art. This can require as much as three minutes, which may be critical in many instances. Obviously, such glass cloth and foil laminate structures leave much to be desired.

Furthermore, bulldozers and other expensive firefighting equipment, as well as dwellings, storage facilities and boats, receive virtually no protection whatsoever. Current damage-prevention practice, where such exists, calls for not using such equipment at all, or abandoning the equipment or structure if the fire threatens it. Thus, it is apparent that none of the prior art temporary emergency protection structures have been entirely satisfactory.

BRIEF SUMMARY AND OBJECTS OF INVENTION

These disadvantages of prior art temporary emergency shelters are overcome with the present invention and improved temporary emergency structures are provided which can be deployed quickly and easily with little, if any, prior training or area preparation and which can safely protect personnel, equipment, structures, vessels etc, against temperatures of at least 2000° F. for short periods of time and can also provide temporary shelter against harsh arctic, desert or jungle environments.

The advantages of the present invention are preferably attained by providing improved temporary emergency structures comprising inflatable frameworks formed of ultra-high temperature resistant fabric tubing which supports, isolates and insulates the protected person or other equipment from the ground and which serves to support a cover formed of ultra-high temperature resistant fabric cloth.

Accordingly, it is an object of the present invention to provide improved temporary emergency structures.

Another object of the present invention is to provide improved temporary emergency structures which can protect personnel, structures, vessels, equipment and the like.

An additional object of the present invention is to provide improved temporary emergency structures which can be deployed quickly and easily with little, if any, prior training or area preparation.

Another object of the present invention is to provide improved temporary shelter against fires, or harsh arctic, desert or jungle environments.

A further object of the present invention is to provide improved temporary emergency structures which can safely protect personnel and equipment against temperatures of at least 2000° F. for short periods of time.

A specific object of the present invention is to provide improved temporary emergency structures comprising inflatable frameworks formed of ultra-high temperature resistant fabric or other appropriate tubing which may insulate the protected person, structure, vessel, equipment or the like from hostile ground and environmental conditions and which serves to support a cover formed of ultra-high temperature resistant fabric.

These and other objects and features of the present invention will be apparent form the following detailed description, taken with reference to the figures of the accompanying drawing.

BRIEF DESCRIPTION OF THE DRAWING

FIG. 5 is a plan view, partly in section, showing a modified form of the temporary emergency structure of FIG. 1 for use in protecting equipment, such as bulldozers and the like;

DETAILED DESCRIPTION OF THE INVENTION

Figure 1:
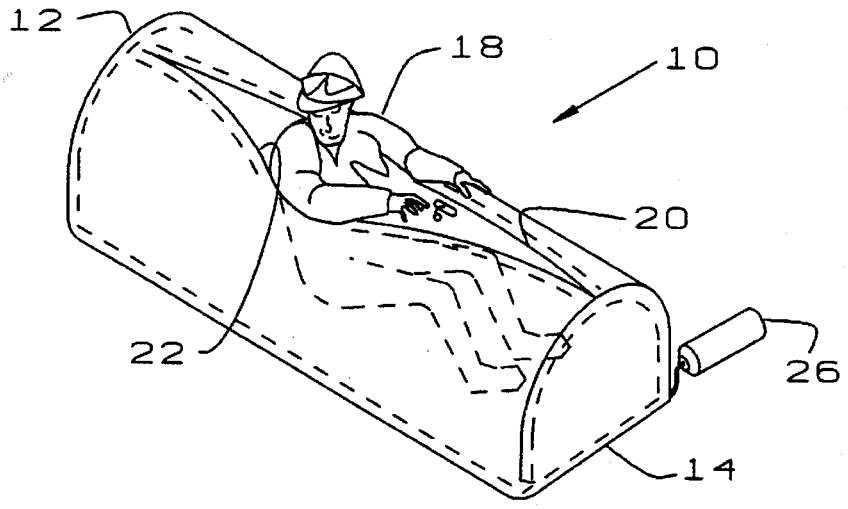
FIG. 1 is an isometric view of a temporary emergency structure embodying the present invention, showing a firefighter entering the temporary structure.
Figure 2:
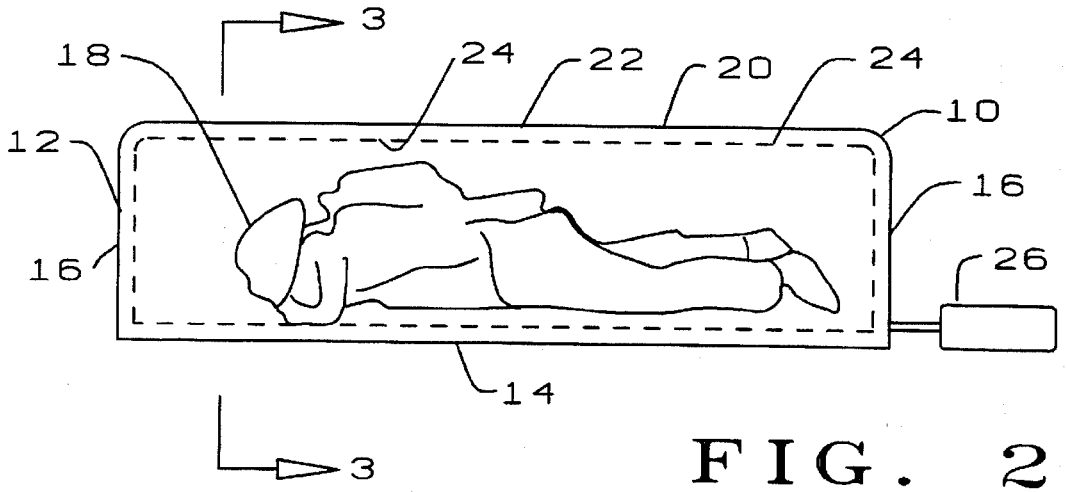
FIG. 2 is a longitudinal section through the temporary structure of FIG. 1, showing the firefighter within the interior of the temporary structure.
Figure 3:
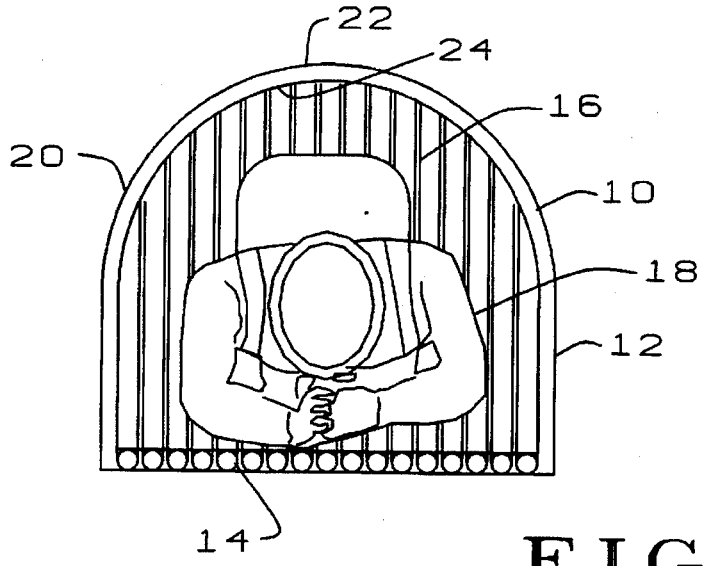
FIG. 3 is a transverse section through the temporary structure of FIG. 1, taken on the line 3—3 of FIG. 2.

In that form of the present invention chosen for purposes of illustration, FIGS. 1–3 show a temporary emergency structure, indicated generally at 10, an inflatable framework 12 formed of a plurality of contiguous inflatable tubes connected together and formed of ultra-high temperature resistant fabric, defining a bottom 14 and end walls 16, which may insulate the protected fireman or other user 18 or equipment from the ground and which serves to support a cover 20 formed of ultra-high temperature resistant fabric cloth. The cover 20 is formed with an opening 22, which permits the fireman 18 to enter and exit the structure 10 and releasable fastening means, such as strips 24 of hook-and-loop material, are provided to permit the fireman 18 to close the opening 22 after entry. Suitable means, such as compressed air bottle 26 may be provided to inflate the tubing 12. Obviously, if desired, appropriate valves, pumps, gas generators or the like could be provided in addition to or alternative to the air bottle 26. It has been found that ultra-high temperature resistant fabric material can be formed of ceramics, composites, carbon filaments and the like and are capable of withstanding temperatures of at least 2000° F. for short periods of time. Suitable materials include those available commercially under the trademark "NEXTEL", available from 3M Corporation, Ceramic Material Dept., St. Paul, Minn. 55144-1000, or "ZETEX", available from NEWTEX Industries, Inc., 8050 Victor-Mendon Rd., Victor, N.Y. 14564 Portland, Oreg. 97220.

Figure 4:
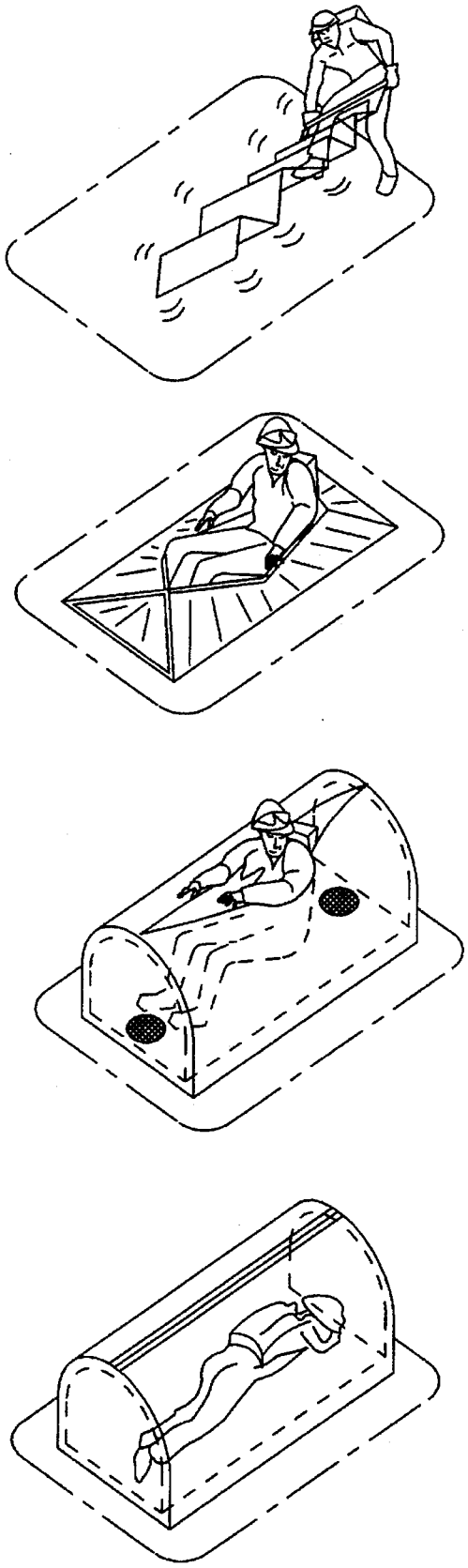
FIG. 4 is a diagrammatic representation showing a firefighter deploying and entering the temporary structure of FIG. 1.

In use, the inflatable structure 10 is normally deflated and can be contained in a backpack or other carrying case, not shown, for storage and transportation. However, if the fireman 18 finds himself threatened by approaching flames, he finds a nearby clearing, clears away any flammable litter, if time permits, removes the inflatable structure 10 from its container, not shown, and shakes it open. Thereafter, he enters the structure 10 through opening 22 and enters the structure 10, as seen in FIG. 4-2. Once inside, he closes the opening 22, by means of the releasable fastening means 24 and lies down within the structure 10, as seen in FIGS. 2,3 and 4—6. The inflatable framework 12 is formed of ceramic, or other, fabric material which can withstand temperatures of at least 2000° F. for short periods of time and, hence, serves to insulate the fireman 18 from the ground under the bottom 14 of the inflatable structure 10, while the end walls 16 serve to support the cover 20, which is also formed of ceramic fiber material, which protects the fireman 18 and prevents the air within the structure 10 from becoming excessively heated. Thus, the air contained within the inflatable structure 10 also serves to insulate the fireman 18 from the flames and heat external to the inflatable structure 10. Once the danger has passed, the fireman 18 can undo the releasable fastening means 24 and can exit the inflatable structure 10 through opening 22. Then, the inflatable structure 10 can be restowed in its container, not shown, for subsequent refurbishment, recertification and reuse.

Figure 5:
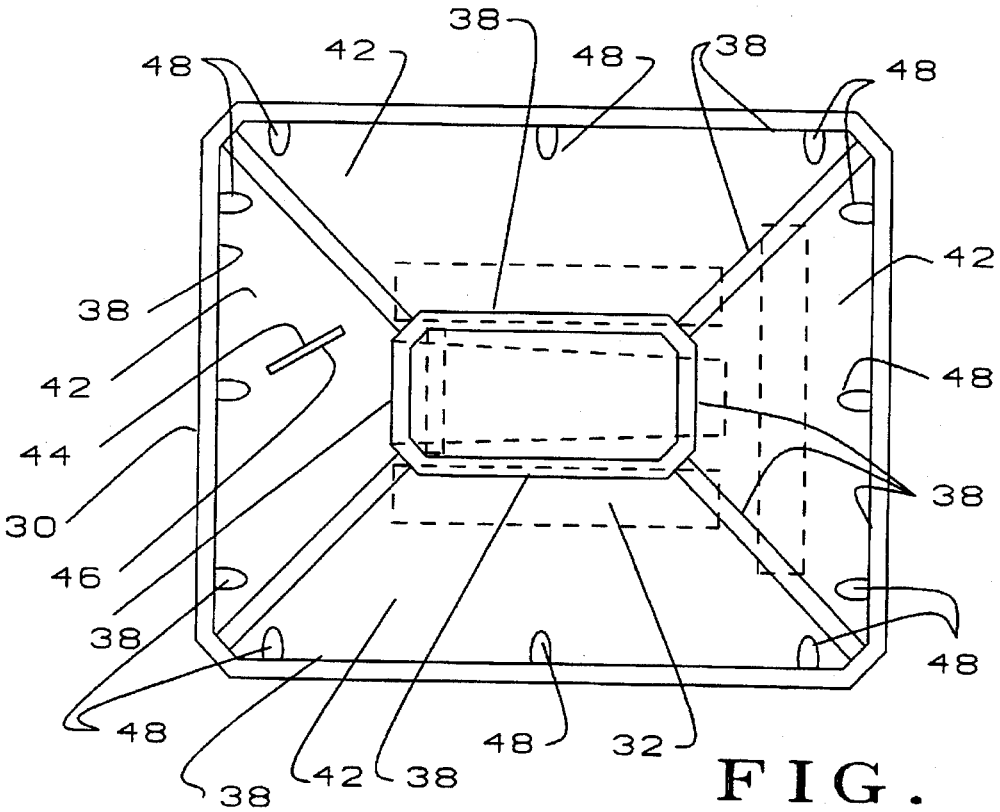
Figure 6:
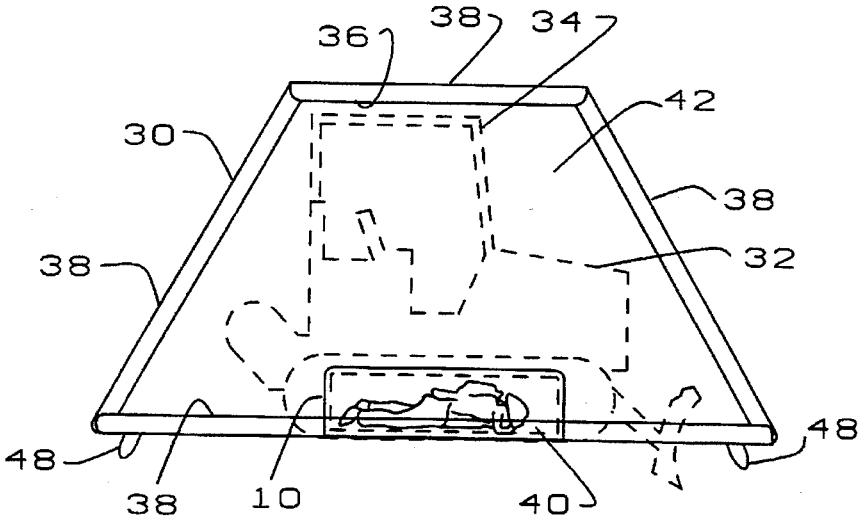
FIG. 6 is a side view of the temporary emergency structure of FIG. 4.

FIGS. 5 and 6 show an alternative form of the inflatable structure, indicated generally at 30, for use in protecting large and expensive firefighting or other equipment, such as bulldozer 32. In this form of the invention, the inflatable structure 30 is normally deflated and is stowed in a cannister 34 or the like, mounted in any convenient location, such as on the roof 36 of the bulldozer 32. When threatened by approaching flames, the operator 40 can actuate suitable means to deliver compressed air into inflatable tubing 38 to deploy the inflatable structure 30 and to support cover 42 to enclose and protect the bulldozer 32 and the operator 40. If desired, an opening 44 may be provided in the cover 42 to allow entry into and exit from the inflatable structure 30 and releasable fastening means, such as strips 46 of hook-and-loop material, may be provided to allow the operator 40 to releasably close the opening 44. Also, loops 48 may be provided at appropriate locations about the periphery of the inflatable structure 30 to allow the operator to secure the edges of the inflatable structure 30 by suitable means such as tent pegs or weights, not shown.

Figure 7:
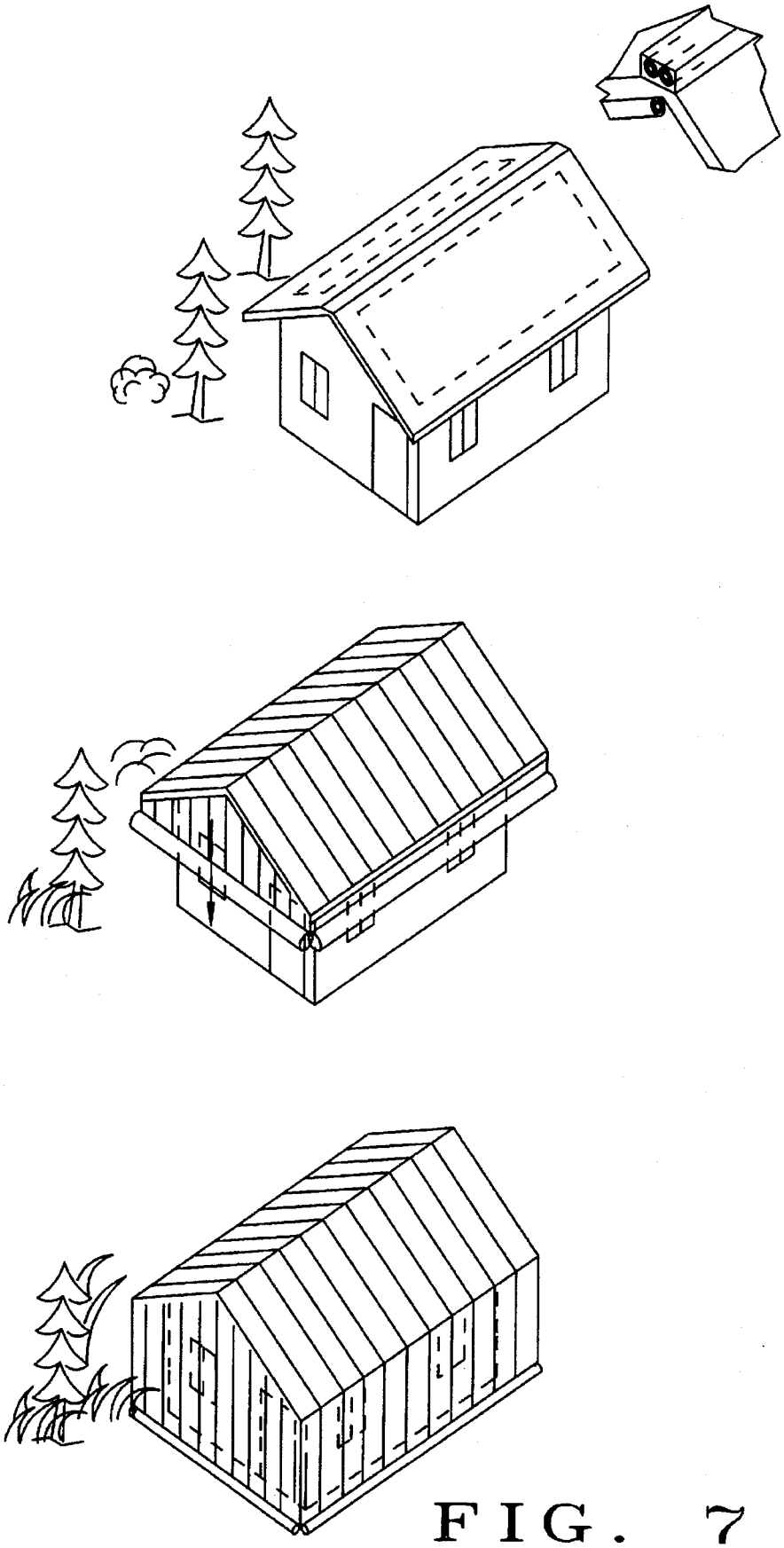
FIG. 7 is a diagrammatic representation, similar to that of FIG. 4, showing the temporary structure of FIG. 1 being deployed to protect a vessel against an oil fire at sea.
Figure 8:
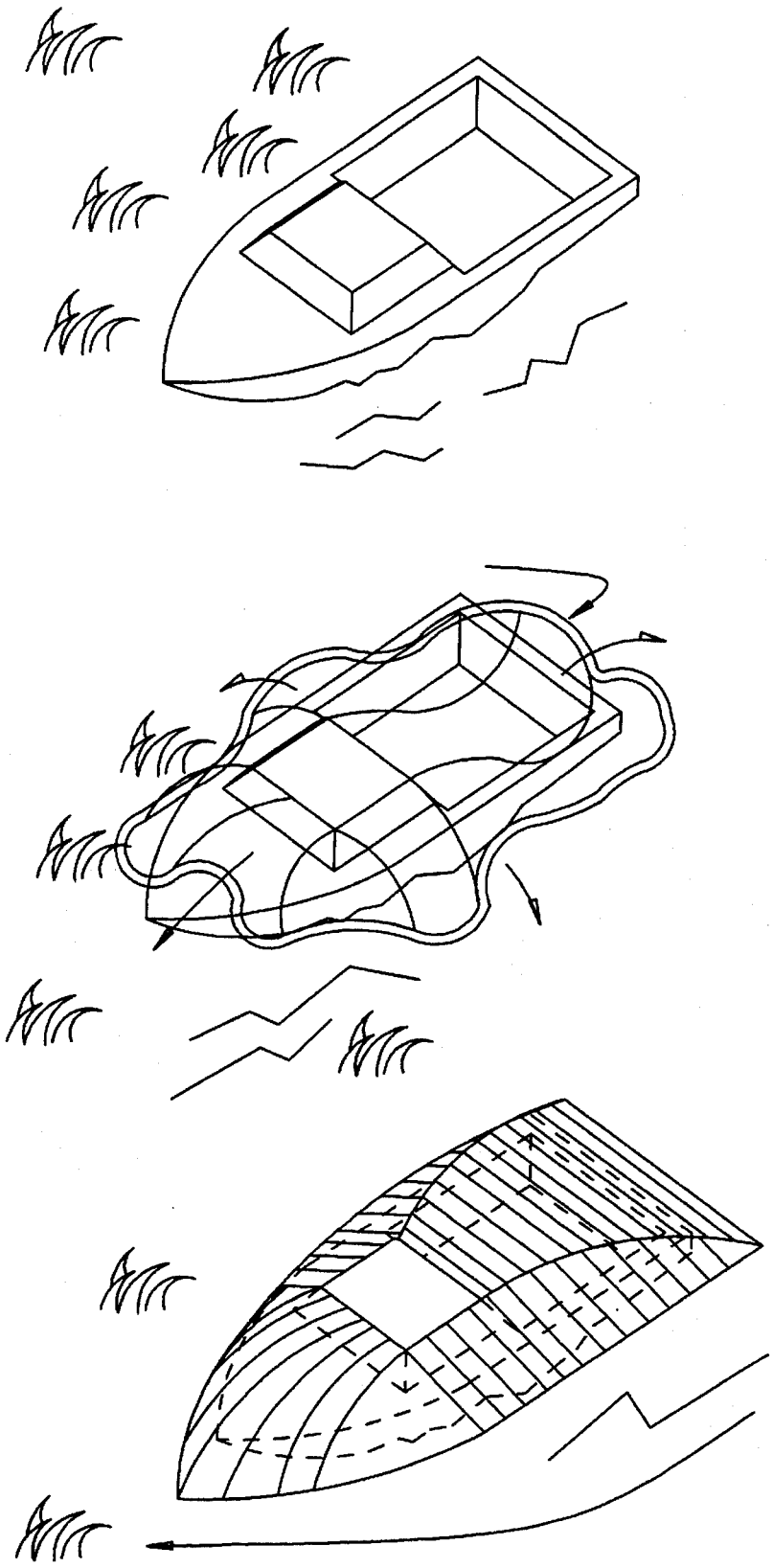
FIG. 8 is a diagrammatic representation, similar to that of FIG. 4, showing the temporary structure of FIG. 1, being deployed to proctect a building.

In use, the inflatable structure 30 is normally deflated and stowed in the housing 34 on the roof 36 of the bulldozer 32. When needed, the operator finds or scrapes a suitable clearing and actuates suitable means, not shown, to inflate the inflatable tubing 38. The inflatable tubing 38 extends itself about the bulldozer 32 and supports the cover 42 to form a protective tent about the bulldozer 32. The operator, then, drives tent pegs, or the like through loops 48, or uses weights, to secure the periphery of the inflatable structure 30. If available, the operator 40 may deploy a personal temporary emergency structure, such as that shown at 10 in FIGS. 1-4, within the inflatable structure 30 and enters it, as described above. It will also be apparent that the inflatable structure 30 could, if desired, be mounted on the roof of a building, such as a house, shed or the like as seen in FIG. 7, or on a vessel, as seen in FIG. 8, to provide protection for such building in the event of a fire.

Obviously, numerous variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A temporary emergency structure comprising:

an inflatable framework formed from a plurality of contiguous inflatable tubes connected together and forming at least a partial floor, said inflatable tubes formed of ultra-high temperature resistant fabric, a cover of ultra-high temperature resistant cloth supported by said framework and expandable during inflation of said framework to define an area of protection about an article to be protected, and means actuable to inflate said framework.

2. The structure of claim 1 wherein:

said article is a person.

3. The structure of claim 1 wherein:

said article is an item of firefighting equipment.

4. The structure of claim 1 wherein:

said article is a building.

5. The structure of claim 1 wherein:

said article is a vessel.

6. The structure of claim 1 further comprising:

a container for storing and transporting said structure prior to inflation.

7. The structure of claim 6 wherein:

said container is a portable by a person.

8. The structure of claim 6 wherein:

said container is a backpack.

9. The structure of claim 6 wherein:

said container is a housing mountable on an article to be protected.

10. The structure of claim 1 further comprising:

an opening formed in said cover to permit entry into and exit from said structure, and releasable fastening means for releasably closing said opening.

11. The structure of claim 1 further comprising:

loops provided at appropriate locations about the periphery of said structure to facilitate securing said structure to the ground.

12. The structure of claim 1 wherein:

said fabric is capable of withstanding temperatures up to at least 2000° F. for short periods of time.

13. The structure of claim 1 wherein:

said fabric is formed of ceramic.

14. The structure of claim 1 wherein:

said fabric is formed of carbon filaments.

15. The structure of claim 1 wherein:

said fabric is formed of composites.

* * * * *